US007565897B2

(12) United States Patent
Inui

(10) Patent No.: US 7,565,897 B2
(45) Date of Patent: Jul. 28, 2009

(54) INTERNAL COMBUSTION ENGINE

(75) Inventor: Hiroatsu Inui, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 114 days.

(21) Appl. No.: 11/709,692

(22) Filed: Feb. 23, 2007

(65) Prior Publication Data

US 2007/0199543 A1 Aug. 30, 2007

(30) Foreign Application Priority Data

Feb. 28, 2006 (JP) ..... 2006-052863
Feb. 28, 2006 (JP) ..... 2006-052864

(51) Int. Cl.
*F02B 15/00* (2006.01)
*F02M 35/10* (2006.01)
*F01L 1/26* (2006.01)

(52) U.S. Cl. ..... 123/432; 123/315; 123/188.14; 123/90.23

(58) Field of Classification Search ..... 123/308, 123/315, 432, 188.14, 661, 90.22, 90.23, 123/184.34
See application file for complete search history.

(56) References Cited

U.S. PATENT DOCUMENTS 4,527,518 A * 7/1985 Osaki et al. ..... 123/90.23
4,872,431 A * 10/1989 Akao et al. ..... 123/315
5,429,086 A * 7/1995 Glackin ..... 123/308
5,555,869 A * 9/1996 Uchida ..... 123/308
5,852,994 A * 12/1998 Tsuzuku et al. ..... 123/308
5,906,186 A * 5/1999 Aoyama ..... 123/432
6,276,330 B1 * 8/2001 Adamisin et al. ..... 123/308
6,860,252 B1 * 3/2005 Ganoung ..... 123/308

FOREIGN PATENT DOCUMENTS

EP 0 075 643 A2 4/1983
JP 7-63065 A 3/1995
JP 2537205 B2 7/1996

* cited by examiner

*Primary Examiner*—Willis R Wolfe, Jr.
(74) *Attorney, Agent, or Firm*—Birch, Stewart, Kolasch & Birch, LLP

(57) ABSTRACT

In an internal combustion engine includes an intake valve port that opens into a combustion chamber on one side of a plane containing the axis of a cylinder bore. An exhaust valve port opens into the combustion chamber on the other side of the plane. A spark plug has a tip end that fronts a substantially central portion of the combustion chamber. The spark plug is disposed between the intake valve and the exhaust valve. In order to restrain the blow-by of an unburned fuel-air mixture, and to suppress the bulging of the cylinder head to the intake system side, the operation axis of an intake valve is set to be substantially parallel to the axis of the cylinder bore. In addition, one side surface of a cylinder head is formed to be substantially parallel to the axis of the cylinder bore.

17 Claims, 6 Drawing Sheets

INTERNAL COMBUSTION ENGINE

CROSS-REFERENCE TO RELATED APPLICATIONS

This nonprovisional application claims priority under 35 U.S.C. § 119(a) on Patent Application Nos. 2006-052863 and 2006-052864, each filed in Japan on Feb. 28, 2006. The entirety of each of these applications is incorporated herein by reference.

FIELD OF THE INVENTION

A first aspect of the present invention relates to an internal combustion engine that includes a piston slidably fitted in a cylinder bore. A combustion chamber is formed between a cylinder block and a cylinder head, a top portion of the piston fronting on the combustion chamber. An intake valve port is opened and closed by an intake valve, the intake valve port being provided in the cylinder head in the state of opening into the combustion chamber on one side of a plane containing the axis of the cylinder bore. An exhaust valve port is opened and closed by an exhaust valve, the exhaust valve port being provided in the cylinder head in the state of opening into the combustion chamber on the other side of the plane. A spark plug has a tip end that fronts on a substantially central portion of the combustion chamber. The spark plug is attached to the cylinder head in the state of being disposed between the intake valve and the exhaust valve.

A second aspect of the present invention relates to an internal combustion engine that includes a piston slidably fitted in a cylinder bore. A combustion chamber is formed between a cylinder block and a cylinder head, a top portion of the piston fronting on the combustion chamber. The cylinder head is provided with an intake valve port opening into the combustion chamber on one side of a plane containing the axis of the cylinder bore and with an exhaust valve port opening into the combustion chamber on the other side of the plane. An intake valve is disposed in the cylinder head to be able to open and close the intake valve port. A camshaft drives the intake valve to open and close. The camshaft is disposed on the operation axis of the intake valve. An exhaust valve is disposed in the cylinder head to be able to open and close the exhaust valve port. A rocker shaft is fixedly disposed between the exhaust valve and the camshaft. A rocker arm is swung according to rotation of the camshaft so as to drive the exhaust valve for opening and closing, the rocker arm being swingably borne by the rocker shaft.

DESCRIPTION OF BACKGROUND ART

An internal combustion engine according to the first aspect of the present invention has been known from, for example, Japanese Patent Laid-open No. Hei 7-63065. In this internal combustion engine, the operation axes of an intake valve and an exhaust valve are so set as to skewly intersect a plane containing the axis of a cylinder bore. A spark plug is attached to a cylinder head while being located coaxially on the axis of the cylinder bore.

However, in the internal combustion engine disclosed in Japanese Patent Laid-open No. Hei 7-63065, part of a fuel-air mixture flowing into the combustion chamber via the intake valve port flows toward the side of the exhaust valve port and the spark plug. Therefore, in the case of performing an operation in which the intake gas charging effect is enhanced by overlapping a part of the intake valve opening period with a part of the exhaust valve opening period, part of the fuel-air mixture would blow by through the exhaust valve port in an unburned state, thereby increasing the fuel consumption, and it would be necessary to after-treat the unburned fuel-air mixture. In addition, where a tip end portion of the spark plug is disposed to face the intake valve port, there would be a problem (particularly, at the time of warming up) in that the spark plug becomes sooty.

An internal combustion engine according to the second aspect of the present invention has been known from, for example, Japanese Patent No. 2537205. In the internal combustion engine, the operation axes of a pair of exhaust valves are set substantially parallel to the axis of the cylinder bore. The operation axes of a pair of intake valves are set to skewly intersect the operation axes of the exhaust valves.

However, in the internal combustion engine disclosed in Japanese Patent No. 2537205, a fuel-air mixture flows skewly into the combustion chamber via the intake valve port when the intake valve is opened, so that diffusion of the fuel-air mixture in the combustion chamber cannot be said to be favorable, and the combustion efficiency also cannot be said to be sufficient. In addition, since the intake valve is inclined with its stem end spaced away from the axis of the cylinder bore, the side surface of the cylinder head on the side where the intake port is provided must be set at a position comparatively remote from the axis of the cylinder bore. Therefore, the degree of freedom in laying out the intake system connected to the cylinder head is lowered.

SUMMARY OF THE INVENTION

The first aspect of the present invention has been made in consideration of the above circumstances. Accordingly, it is an object of the present invention to provide an internal combustion engine in which the blow-by of an unburned fuel-air mixture and the problem that the spark plug becomes sooty can be restrained.

In order to attain the above object, the first aspect of the present invention resides in an internal combustion engine comprising a piston slidably fitted in a cylinder bore, a combustion chamber formed between a cylinder block and a cylinder head, a top portion of said piston fronting on the combustion chamber, an intake valve port opened and closed by an intake valve, the intake valve port being provided in the cylinder head in the state of opening into the combustion chamber on one side of a plane containing the axis of the cylinder bore, an exhaust valve port opened and closed by an exhaust valve, the exhaust valve port being provided in the cylinder head in the state of opening into the combustion chamber on the other side of the plane, and a spark plug of which the tip end fronts on a substantially central portion of the combustion chamber, the spark plug being attached to the cylinder head in the state of being disposed between the intake valve and the exhaust valve, wherein the operation axis of the intake valve is set to be substantially parallel to the axis of the cylinder bore.

In addition, in the first aspect of the present invention, a ceiling surface of the combustion chamber is provided, between the spark plug and the intake valve port, with a partition wall projecting toward the piston side.

Furthermore, in the first aspect of the present invention, the tip end of the spark plug is disposed at substantially the same position as a projecting end of the partition wall.

In addition, in the first aspect of the present invention, the operation axis of the exhaust valve is so set as to skewly intersect the plane, and at least a part of the exhaust valve port is disposed on the upper side relative to the partition wall.

According to the first aspect of the present invention, the operation axis of the intake valve is set substantially parallel to the axis of the cylinder bore, whereby the flow direction of the fuel-air mixture flowing via the intake valve port into the combustion chamber when the intake valve is opened is made to be mainly parallel to the axis of the cylinder bore. Therefore, it is possible to restrain the fuel-air mixture from flowing toward the spark plug or the exhaust valve port in an unburned state, and thereby to suppress the blow-by of the unburned fuel-air mixture and the problem that the spark plug becomes sooty.

In addition, according to the first aspect of the present invention, the tip end of the spark plug is set at substantially the same position as the projecting end of the partition wall, whereby favorable flame propagation can be achieved while suppressing the phenomenon in which the spark plug becomes sooty.

Furthermore, according to the first aspect of the present invention, the operation axis of the exhaust valve skewly intersects the plane containing the axis of the cylinder bore. Therefore, the side of the exhaust valve port that is close to the intake valve is located at a deeper position from the partition wall, so that the blow-by of the unburned fuel-air mixture can be restrained more effectively.

The second aspect of the present invention has also been made in consideration of the above circumstances. Accordingly, it is an object of the present invention to provide an internal combustion engine in which the flow of a fuel-air mixture into a combustion chamber is improved, the combustion efficiency is thereby enhanced, and bulging of a cylinder head toward the intake system side is suppressed, whereby the degree of freedom in laying out the intake system is enhanced.

In order to attain the above object, the second aspect of the present invention resides in an internal combustion engine comprising a piston slidably fitted in a cylinder bore, a combustion chamber formed between a cylinder block and a cylinder head, a top portion of the piston fronting on the combustion chamber, the cylinder head being provided with an intake valve port opening into the combustion chamber on one side of a plane containing the axis of the cylinder bore and with an exhaust valve port opening into the combustion chamber on the other side of the plane, an intake valve disposed in the cylinder head to be able to open and close the intake valve port, a camshaft for driving the intake valve for opening and closing, the camshaft being disposed on the operation axis of the intake valve, an exhaust valve disposed in the cylinder head to be able to open and close the exhaust valve port, a rocker shaft fixedly disposed between the exhaust valve and the camshaft, and a rocker arm swung according to rotation of the camshaft so as to drive the exhaust valve for opening and closing, the rocker arm being swingably borne by the rocker shaft, wherein the operation axis of the intake valve is set substantially parallel to the axis of the cylinder bore, and one side surface of the cylinder head, in which an intake port opens contiguous with the intake valve port, is formed to be substantially parallel to the axis of the cylinder bore.

In addition, in the second aspect of the present invention, an intake system member connected to the intake port is displayed substantially along one side surface of the cylinder head.

Furthermore, in the second aspect of the present invention, the intake valves are disposed respectively on the sides, close to each other, of a pair of the cylinder heads respectively constituting parts of a pair of banks disposed in a mutually V-shaped arrangement.

Incidentally, the throttle body 56 in the embodiment described below corresponds to the intake system member in the present invention.

According to the second aspect of the present invention, the operation axis of the intake valve is set substantially parallel to the axis of the cylinder bore, so that the fuel-air mixture flows via the intake valve port into the combustion chamber substantially in parallel to the axis of the cylinder bore when the intake valve is opened, whereby the diffusion of the fuel-air mixture in the combustion chamber is improved, and the combustion efficiency can be enhanced. Moreover, one side surface of the cylinder head, in which the intake port opens, is formed substantially parallel to the axis of the cylinder bore. Therefore, the side surface of the cylinder head on the side where the intake port is provided can be set at a position close to the axis of the cylinder bore, whereby bulging of the cylinder head toward the intake system side can be suppressed, and the degree of freedom in laying out the intake system can be enhanced.

In addition, according to the second aspect of the present invention, the intake system member is disposed substantially along one side surface of the cylinder head. Therefore, the amount of bulging of the internal combustion engine inclusive of the intake system from the axis of the cylinder bore can be suppressed, and the internal combustion engine can be configured in a compact form.

Furthermore, according to the second aspect of the present invention, without setting the angle between both banks in a V-type internal combustion engine to be large, the layout of the intake system in the space formed between both banks is facilitated, which contributes to realization of the V-type internal combustion engine in a compact form.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
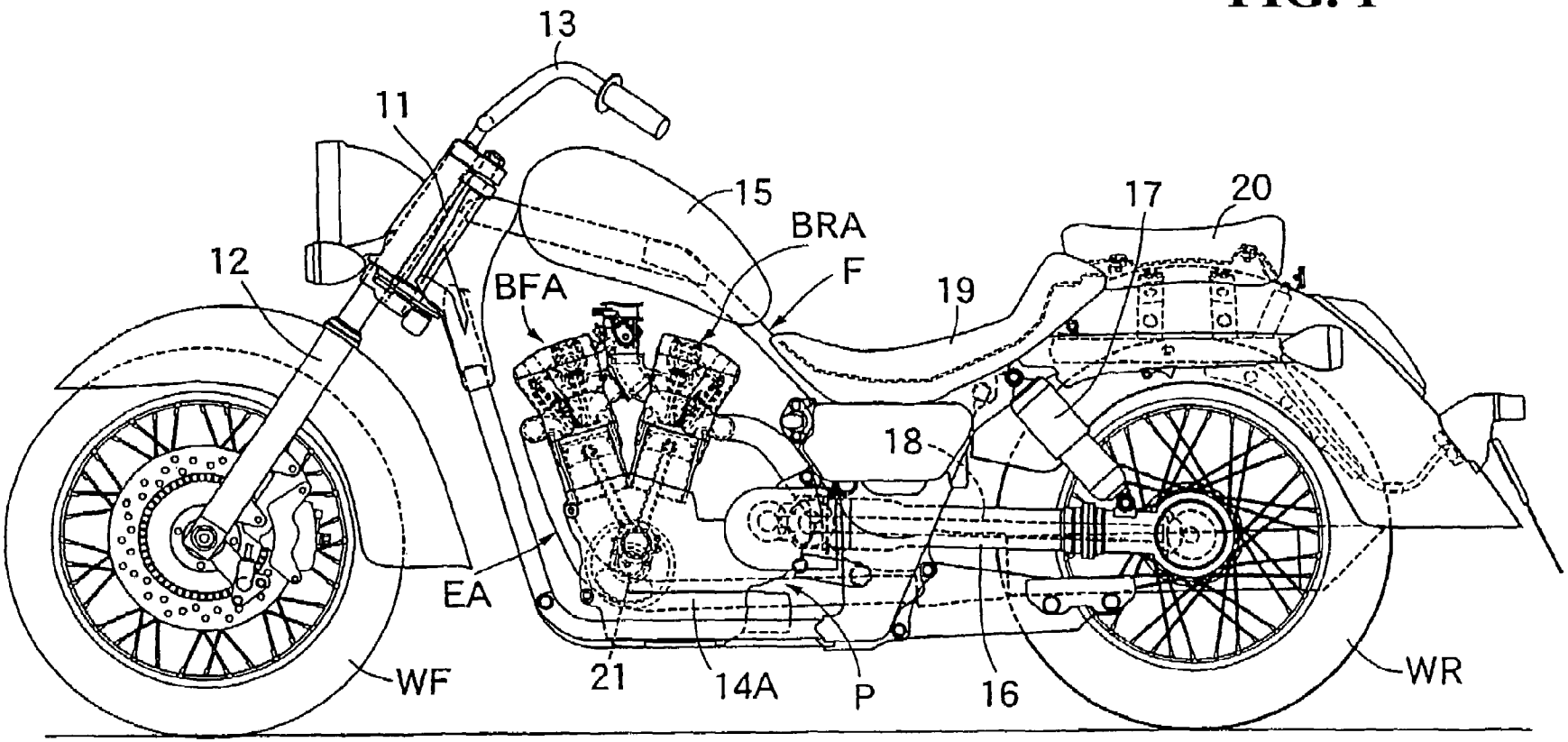
FIG. 1 is a side view of a motorcycle pertaining to a first embodiment of the present invention.

The present invention will now be described with reference to the accompanying drawings, wherein the same reference numerals have been used to identify the same or similar elements throughout the several views.

Figure 2:
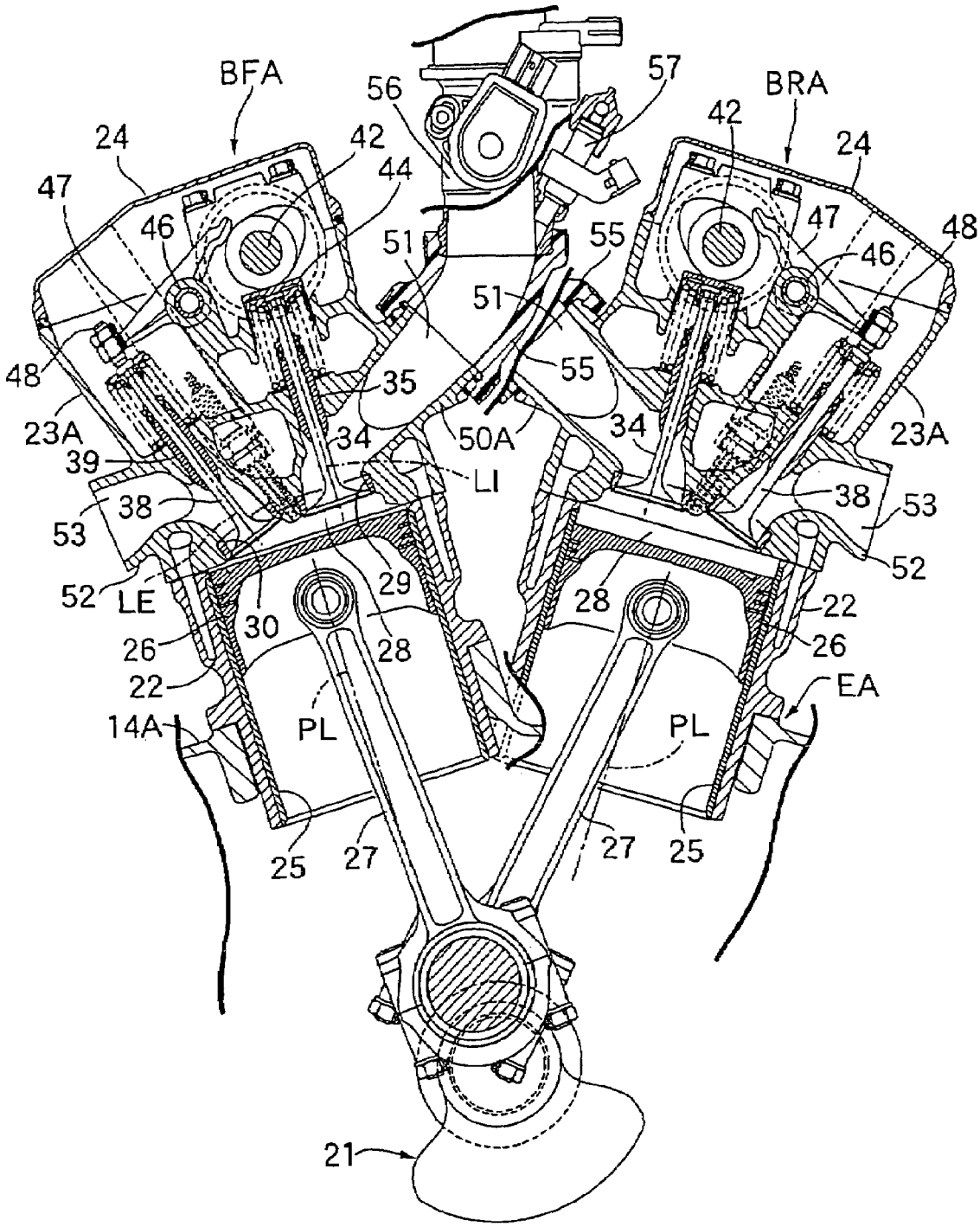
FIG. 2 is a vertical sectional side view of an essential part of an internal combustion engine.
Figure 3:
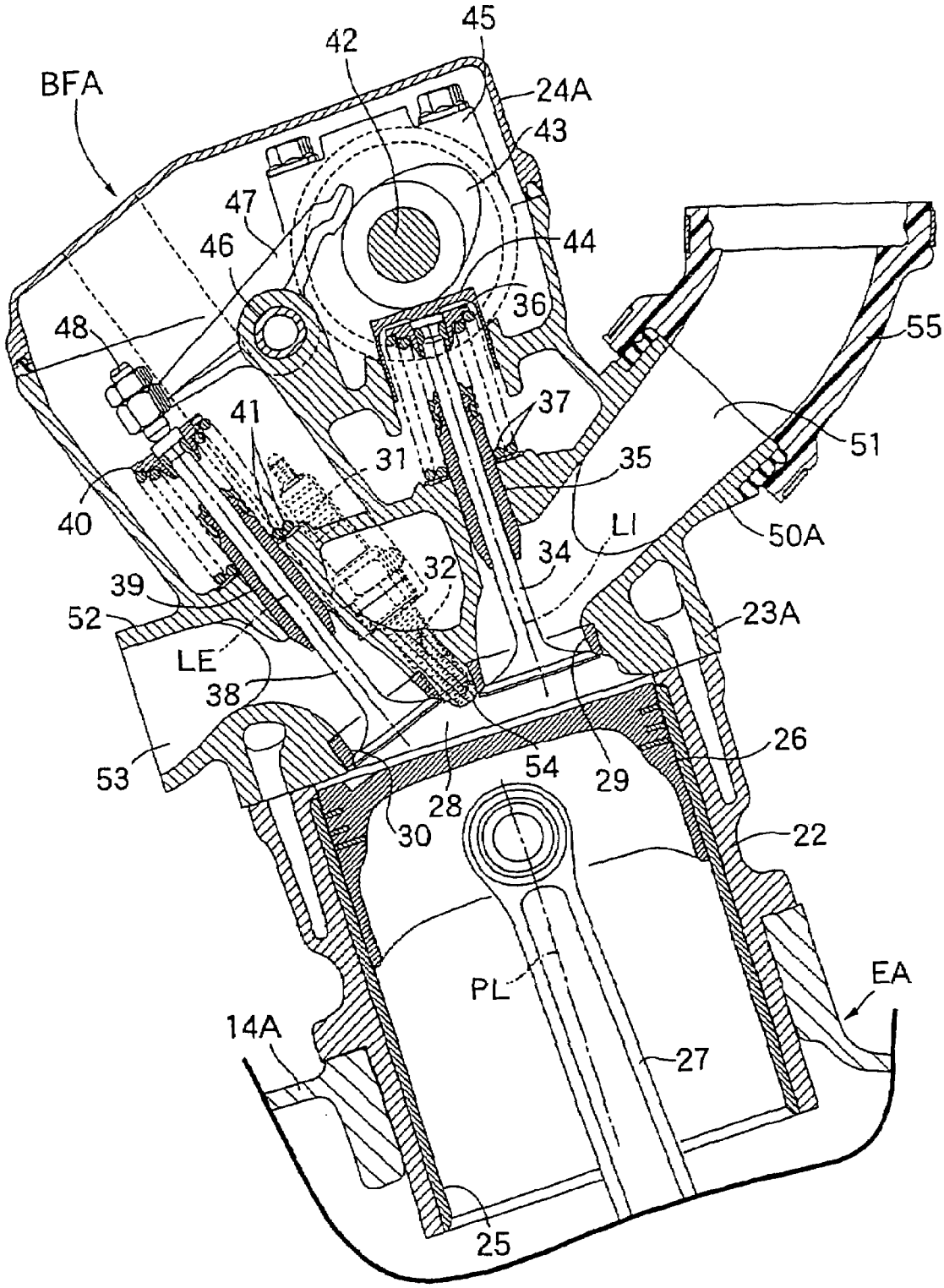
FIG. 3 is an enlarged view of an essential part of FIG. 1.

FIGS. 1 to 3 show a first embodiment of the present invention, in which FIG. 1 is a side view of a motorcycle, FIG. 2 is a vertical sectional side view of an essential part of an internal combustion engine, and FIG. 3 is an enlarged view of an essential part of FIG. 1.

First, in FIG. 1, a front fork 12 for rotatably supporting a front wheel WF is steerably borne on a head pipe 11 provided at the front end of a vehicle body frame F of the motorcycle. A steering handle 13 is connected to the front fork 12. In addition, a power unit P composed of an internal combustion engine EA and a transmission (not shown) contained in a crankcase 14A possessed by the internal combustion engine EA is mounted on a front portion of the vehicle body frame F. A fuel tank 15 is mounted on a front portion of the vehicle body frame F so as to cover the upper side of the internal combustion engine EA.

The front ends of a left-right pair of swing arms 16 extending in the front-rear direction are vertically swingably borne on the vehicle body frame F on the rear side relative to the power unit P. A rear wheel WR is rotatably supported between rear portions of both the swing arms 16. In addition, rear cushion units 17 are interposed between the vehicle body frame F and rear portions of both the swing arms 16, respectively. Moreover, the left swing arm 16 of the swing arms 16 is formed in a tubular shape. A drive shaft 18 for transmitting power from the power unit P to the rear wheel WR is contained in the left swing arm 16.

A main seat 19 on which a rider is seated is mounted to the vehicle body frame F on the rear side relative to the fuel tank 15. A pillion seat 20 on which a passenger is seated is mounted on the vehicle body frame F on the rear side relative to the main seat 19.

In FIG. 2, the internal combustion engine EA is a V-type internal combustion engine having a first bank BFA provided in connection with the crankcase 14A in the state of being inclined upwards toward the forward side along the running direction of the motorcycle. A second bank BRA is provided in connection with the crankcase 14A on the rear side of the first bank BFA so as to form an upwardly opened V shape together with the first bank BFA. A crankshaft 21 having an axis extending in the left-right direction of the motorcycle is rotatably borne on the crankcase 14A.

In addition, the first and second banks BFA and BRA include cylinder blocks 22 connected to the crankcase 14A, cylinder heads 23A connected to the cylinder blocks 22, and head covers 24 connected to the cylinder head 23A, respectively. Pistons 26 are slidably fitted in cylinder bores 25 provided in the cylinder blocks 22 of both of the banks BFA and BRA, respectively. The pistons 26 in the banks BFA and BRA are connected in common to the crankshaft 21 through connecting rods 27, respectively. Combustion chambers 28 on which top portions of the pistons 26 front are formed between the cylinder blocks 22 and the cylinder heads 23A in the banks BFA and BRA, respectively.

The first and second banks BFA and BRA are configured in line symmetry with respect to a straight line which is orthogonal to the crankshaft 21 at a central portion between the connecting rod 27 possessed by the banks BFA and BRA and which passes through the midpoint between the axes of the cylinder bores 25. In the following, the configuration of the first bank BFA will be described in detail. As for the second bank BRA, essential parts corresponding to those of the first bank BFA will be denoted by the same reference symbols as used for the first bank BFA, and detailed description of the essential parts of the second bank BRA will be omitted.

In FIG. 3, in the cylinder head 23A of the first bank BFA, a pair of intake valve ports 29 disposed on one side of a plane PL containing the axis of the cylinder bore 25 are provided so as to open into the combustion chamber 28. A pair of exhaust valve ports 30 disposed on the other side of the plane PL are provided so as to open into the combustion chamber 28. The exhaust valve ports 30 are formed to be smaller than the intake valve ports 29 in diameter. The cylinder head 23A is provided with a plug mounting hole 32 for mounting a spark plug 31. A tip end of the spark plug fronts on a substantially central portion of the combustion chamber 28.

In this embodiment, the plane PL contains the axis of the cylinder bore 25, and is set to be parallel to the axis of the crankshaft 21. Both of the intake valve ports 29 are disposed on the side of the second bank BRA with respect to the plane PL. Both of the exhaust valve ports 30 are disposed on the opposite side of the second bank BRA with respect to the plane PL.

Intake valves 34 capable of opening and closing the intake valve ports 29 are slidably fitted in guide tubes 35 provided in the cylinder head 23A. Valve springs 37 for urging the intake valves 34 in the valve-closing directions are disposed in a contracted state between retainers 36 fixed to end portions of the intake valves 34 protruding from the guide tubes 35 and the cylinder head 23A. Similarly, exhaust valves 38 capable of opening and closing the exhaust valve ports 30 are slidably fitted in guide tubes 39 provided in the cylinder head 23A. Valve springs 41 for urging the exhaust valves 38 in the valve-closing directions are disposed in a contracted state between retainers 40 fixed to end portions of the exhaust valves 38 protruding from the guide tube 39 and the cylinder head 23A.

A camshaft 42 to which rotational power is transmitted from the crankshaft 21 with a speed reduction ratio of 1/2 is disposed on the operation axes LI of the intake valves 34, namely, on the axes of the guide tubes 35. The camshaft 42 has an axis parallel to the crankshaft 21, and is rotatably borne between a cam holder 45 fastened to the cylinder head 23A and the cylinder head 23A. Cams 43 provided on the camshaft 42 abut on the closed ends of bottomed cylindrical lifters 44. The lifters 44 are fitted in the cylinder head 23A so that they abut on the intake valves 34 and can be slid along the operation axes LI of the intake valves 34. Thus, the intake valves 34 are driven to open and close, according to the rotation of the camshaft 42.

On the other hand, a rocker shaft 46 having an axis parallel to the camshaft 42 is fixedly disposed in the cylinder head 23A, between the exhaust valves 38 and the camshaft 42. Rocker arms 47 having one-side ends in sliding contact with the cams 43 of the cam shaft 42 are provided, and intermediate portions thereof are swingably borne on the rocker shaft 46. Tappet screws 48 screw-engaged with the other end portions of the rocker arms 47 so as to permit adjustment of advanced/retracted positions are abutted on the exhaust valves 38. Thus, the rocker arms 47 are driven to open and close the exhaust valves 38, according to the rotation of the camshaft 42.

The operation axes LI of the intake valves 34 are set substantially parallel to the axis of the cylinder bore 25, whereas the operation axes LE of the exhaust valves 38 are so set as to skewly intersect the plane PL containing the axis of the cylinder bore 25 and parallel to the axis of the crankshaft 21.

One side surface on the second bank BRA side of the cylinder head 23A is formed to be substantially parallel to the axis of the cylinder bore 25. An intake port 51 that is connected in common to both of the intake valve ports 29 is opened into a connecting pipe portion 50A integrally projecting from the one side surface. Similarly, a connecting pipe portion 52 is integrally projected from the other side surface, on the opposite side of the first bank BRA, of the cylinder head 23A. An exhaust port 53 that is connected in common to both of the exhaust valve ports 30 is opened into the connecting pipe portion 52.

In addition, the spark plug 31 is disposed between the intake valves 34 and the exhaust valves 38. The ceiling surface of the combustion chamber 28 is provided with a partition wall 54 projecting to the piston 26 side between the spark plug 31 and the intake valve ports 29. The tip end of the spark plug 31 is disposed at substantially the same position as the projecting end of the partition wall 54. At least a part of the exhaust valve ports 30 is disposed above the partition wall 54.

Referring again to FIG. 2, an intake pipe 55 continuous with the intake port 51 is connected to the connecting pipe portion 50A of the cylinder head 23A in the first bank BFA. A throttle body 56 as an intake system member is connected to the intake pipe 55. Further, a fuel injection valve 57 for injecting a fuel toward the intake port 51 is attached to the throttle body 56.

The throttle body 56 is disposed substantially in parallel to the one side surface of the cylinder head 23A which is formed to be substantially parallel to the axis of the cylinder bore 25 and in which the intake port 51 is opened. In order to dispose the throttle body 56 in this manner, the intake pipe 55 is curved in an arcuate shape.

In addition, the intake valves 34 are disposed respectively on the sides, close to each other, of the cylinder heads 23A, 23A in the first and second banks BFA and BRA. In the second bank BRA, also, like on the first bank BFA side, an intake pipe 55 is connected to a connecting pipe portion 50A of the cylinder head 23A. A throttle body (not shown) is connected to the intake pipe 55. The throttle body on the second bank BRA side overlaps with the throttle body 56 on the first bank BFA side, in the axial direction of the crankshaft 21.

The operation of the first embodiment will now be described. The operation axes LI of the intake valves 34 disposed in the cylinder heads 23A of the first and second banks BFA and BRA are set to be substantially parallel to the axes of the cylinder bores 25 possessed by the cylinder blocks 22, so that the intake valves 34 are capable of opening and closing. Therefore, the flow directions of the fuel-air mixture flowing into the combustion chambers 28 via the intake valve ports 29 when the intake valves 34 are opened are mainly parallel to the axes of the cylinder bores 25, whereby good diffusion of the fuel-air mixture in the combustion chambers 28 can be secured, and the combustion efficiency can be enhanced. In addition, the fuel-air mixture can be restrained from flowing in an unburned state to the spark plugs 31 and/or the exhaust valve ports 30, so that blow-by of the unburned fuel-air mixture can be prevented, and the spark plugs 31 can be prevented from becoming sooty.

One-side surfaces of the cylinder heads 23A, in which the intake ports 51 open continuous with the intake valve ports 29, are formed to be substantially parallel to the axes of the cylinder bores 25. Therefore, when the side surfaces of the cylinder heads 23A on the sides where the intake ports 51 are provided are set at positions close to the axes of the cylinder bores 25, it is possible to suppress the bulging of the cylinder heads 23A to the intake system side, and to enhance the degree of freedom in laying out the intake system.

In addition, since the throttle bodies 56 connected to the intake ports 51 are disposed substantially along the one-side surfaces of the cylinder heads 23A, the amount of bulging of the internal combustion engine EA inclusive of the intake system from the axis of the cylinder bore can be suppressed, and the internal combustion engine EA can be configured in a compact form.

The intake valves 34 are disposed respectively on the sides, close to each other, of the pair of cylinder heads 23A, 23A constituting parts of the pair of banks BFA and BRA arranged in the V shape. Therefore, layout of the intake system in the space formed between the banks BFA and BRA can be facilitated, without setting the angle between the banks BFA and BRA to be large, which contributes to realization of the V-type internal combustion engine EA in a more compact form.

The ceiling surface of the combustion chamber 28 is provided with the partition wall 54 projecting to the piston 26 side between the spark plug 31 and the intake valve ports 29. This, in combination with the substantial parallelism between the operation axis LI of the intake valve 34 and the axis of the cylinder bore 25, ensures that the fuel-air mixture flowing into the combustion chamber 28 via the intake valve port 29 when the intake valve 34 is opened can be restrained more effectively from flowing in its unburned state to the side of the spark plug 31 or the exhaust valve port 30, so that blow-by of the unburned fuel-air mixture can be restrained more effectively, and the spark plug 31 can be restrained more effectively from becoming sooty.

Since the tip end of the spark plug 31 is disposed at substantially the same position as the projecting end of the partition wall 54, good flame propagation can be achieved while restraining the spark plug 31 from becoming sooty.

Furthermore, the operation axis LE of the exhaust valve 38 is so set as to skewly intersect the plane PL containing the axis of the cylinder bore 25. At least a part of the exhaust valve ports 30 is disposed above the partition wall 54. Therefore, the side close to the intake valve 34 of the exhaust valve port 30 is located at a position deeper than the partition wall 54, whereby the blow-by of the unburned fuel-air mixture can be restrained more effectively.

Figure 4:
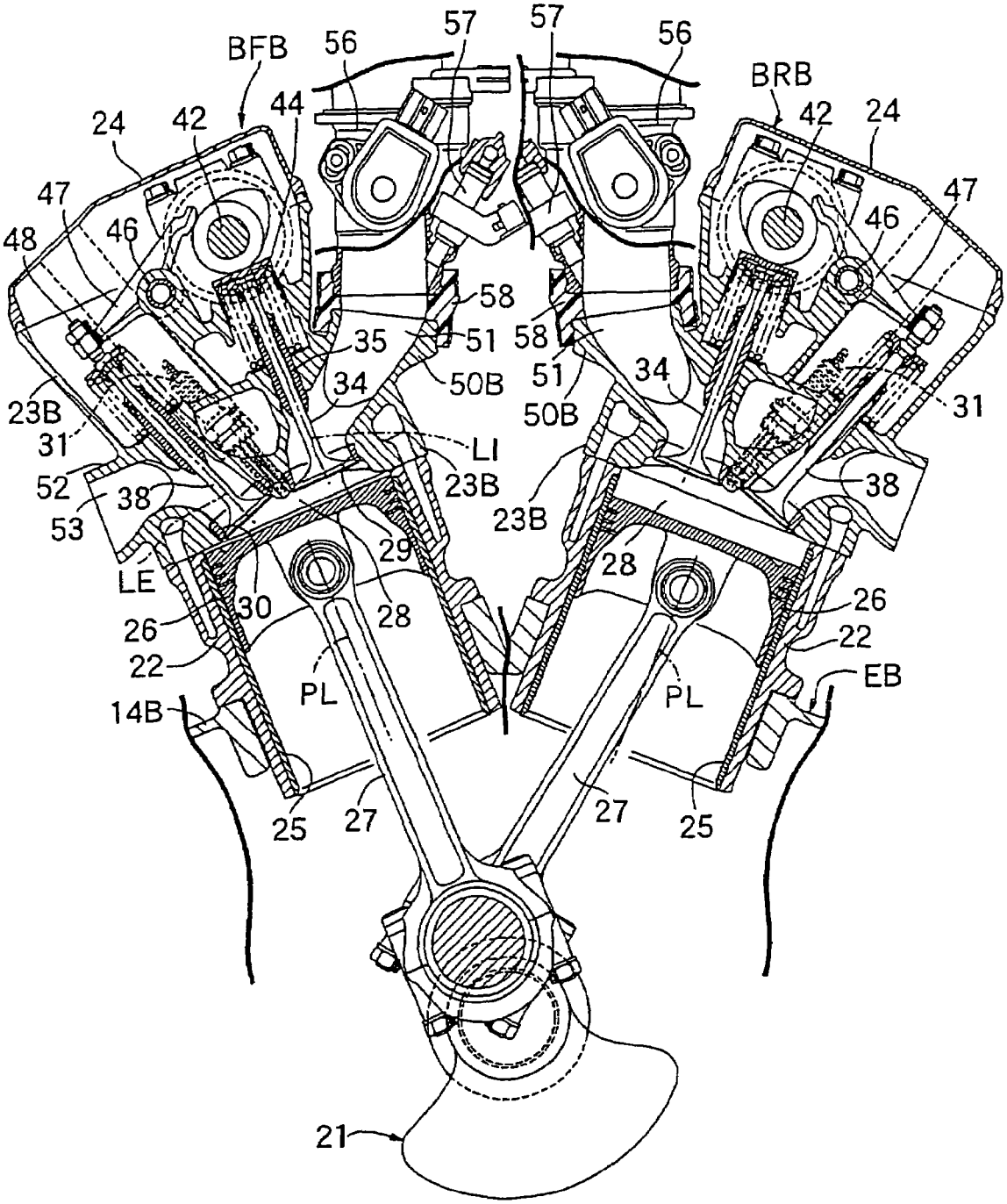
FIG. 4 is a vertical sectional side view, corresponding to FIG. 2, of a second embodiment of the present invention.

FIG. 4 shows a second embodiment of the present invention, in which the parts corresponding to those in the first embodiment are denoted by the same reference symbols as used in the first embodiment, and detailed descriptions of the parts will be omitted.

This internal combustion engine EB is a two-cylinder V-type internal combustion engine having a first bank BFB provided in connection with a crankcase 14B and inclined upwards toward the forward side of the running direction of the motorcycle, and a second bank BRB provided in connection with the crankcase 14B on the rear side of the first bank BFB so as to form an upwardly opened V shape together with the first bank BFB.

In addition, the first and second banks BFB and BRB include cylinder blocks 22 connected to the crankcase 14B, cylinder heads 23B connected to the cylinder blocks 22, and head covers 24 connected to the cylinder heads 23B, respectively. The angle formed between both the banks BFB and BRB is set to be greater than the angle formed between the first and second banks BFA and BRA in the first embodiment.

Intake valves 34 and exhaust valves 38 that are disposed in the cylinder heads 23B so as to be capable of opening and closing are driven to open and close by a camshaft 42 and a rocker arm 47 swingably borne by a rocker shaft 46, in the same manner as in the first embodiment. The operation axes LI of the intake valves 34 are set substantially parallel to the axis of the cylinder bore 25, whereas the operation axes LE of the exhaust valves 34 are so set as to skewly intersect the plane PL containing the axis of the cylinder bore 25 and parallel to the axis of the crankshaft 21. The structure of the combustion chambers 28 is also the same as in the first embodiment.

In addition, one-side surfaces on the sides, close to each other, of the cylinder heads 23B in both the banks BFB and BRB are formed to be substantially parallel to the axes of the cylinder bores 25, and an intake port 51 connected in common to intake valve ports 29 is opened into connecting pipe portions 50B integrally projecting from the one-side surfaces.

In the second embodiment, throttle bodies 56, 56 in the banks BFB and BRB extend in the up-down directions so that they do not overlap with each other as viewed in the direction along the axis of the crankshaft 21, and the throttle bodies 56 are connected to the connecting pipe portions 50B through insulators 58, respectively.

Even in the case where the angle between the banks BFB and BRB must be set comparatively large, by disposing the throttle bodies 56, 56 so as not to overlap with each other as viewed in the direction along the axis of the crankshaft 21, as in the second embodiment, the one-side surfaces of the cylinder heads 23A, in which the intake ports 51 open continuous with the intake valve ports 29, are formed to be substantially parallel to the axes of the cylinder bores 25. Therefore, the side surfaces of the cylinder heads 23B on the sides where the intake ports 51 are provided can be set at positions close to the axes of the cylinder bores 25, whereby the bulging of the cylinder heads 23B to the intake system side can be suppressed. Accordingly, the angle formed between the banks BFB and BRB can be set comparatively small, and a compacter design of the V-type internal combustion engine EB can be obtained.

Figure 5:
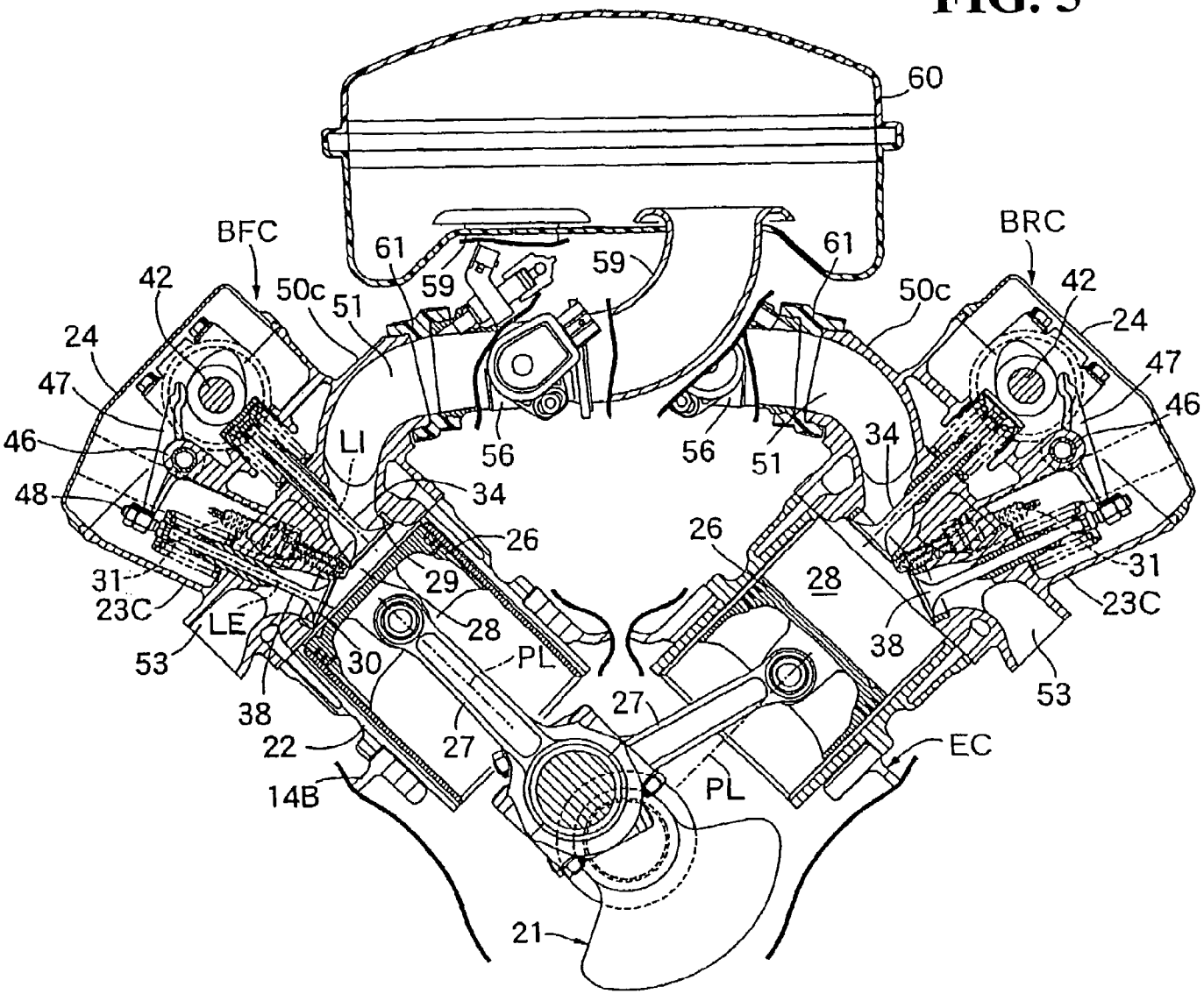
FIG. 5 is a vertical sectional view, corresponding to FIG. 2, of a third embodiment of the present invention.

FIG. 5 shows a third embodiment of the present invention, in which the parts corresponding to those in the first and second embodiments are denoted by the same reference symbols as used in the first and second embodiments, and detailed descriptions of the parts will be omitted.

This internal combustion engine EC is a two-cylinder V-type internal combustion engine having a first bank BFC provided in connection with a crankcase 14C in the state of being inclined upwards toward the forward side in the running direction of the motorcycle. A second bank BRC is provided in connection with the crankcase 14 on the rear side of the first bank BFC so as to form an upwardly opened V shape together with the first bank BFC.

In addition, the first and second banks BFC and BRC include cylinder blocks 22 connected to the crankcase 14C, cylinder heads 23C connected to the cylinder blocks 22, and head covers 24 connected to the cylinder heads 23C. The angle formed between the banks BFC and BRC is set to be greater than the angle formed between the first and second banks BFB and BRB in the second embodiment.

Intake valves 34 and exhaust valves 38 that are disposed respectively in the cylinder heads 23C so as to be capable of opening and closing are driven to open and close by a camshaft 42 and a rocker arm 47 swingably borne by a rocker shaft 46, in the same manner as in the first and second embodiments. The operation axes LI of the intake valves 34 are set substantially parallel to the axis of a cylinder bore 25, whereas the operation axes LE of the exhaust valves 38 are so set as to skewly intersect the plane PL containing the axis of the cylinder bore 25 and parallel to the axis of the crankshaft 21. The structure of combustion chambers 28 is also the same as in the first and second embodiments.

The one-side surfaces on the sides, close to each other, of the cylinder heads 23B in both the banks BFC and BRC are formed to be substantially parallel to the axes of the cylinder bores 25. An intake port 51 that is connected in common to intake valve ports 29 is opened into connecting pipe portions 50C integrally projecting from the one-side surfaces.

In the third embodiment, an air cleaner 60 is disposed between both the banks BFC and BRC. Throttle bodies 56, 56 disposed substantially horizontally on the lower side of the air cleaner 60 are connected to the connecting pipe portions 50C through insulators 61, respectively. Connecting pipes 59 that extend upward from the throttle bodies 56 are connected in common to the air cleaner 60.

Even in the case where the angle formed between both the banks BFC and BRC must be set comparatively large, by disposing the air cleaner 60 between both the banks BFC and BRC as in the third embodiment, the one-side surfaces of the cylinder heads 23A, in which intake ports 51 open continuous with the intake valve ports 29, are formed to be substantially parallel to the axes of the cylinder bores 25. Therefore, side surfaces of the cylinder heads 23C on the sides where the intake ports 51 are provided can be set close to the axes of the cylinder bores 25, and the bulging of the cylinder heads 23C to the intake system side can be thereby suppressed. Accordingly, the angle formed between the banks BFC and BRC can be set comparatively small, and a compacter design of the V-type internal combustion engine EC can be obtained.

Figure 6:
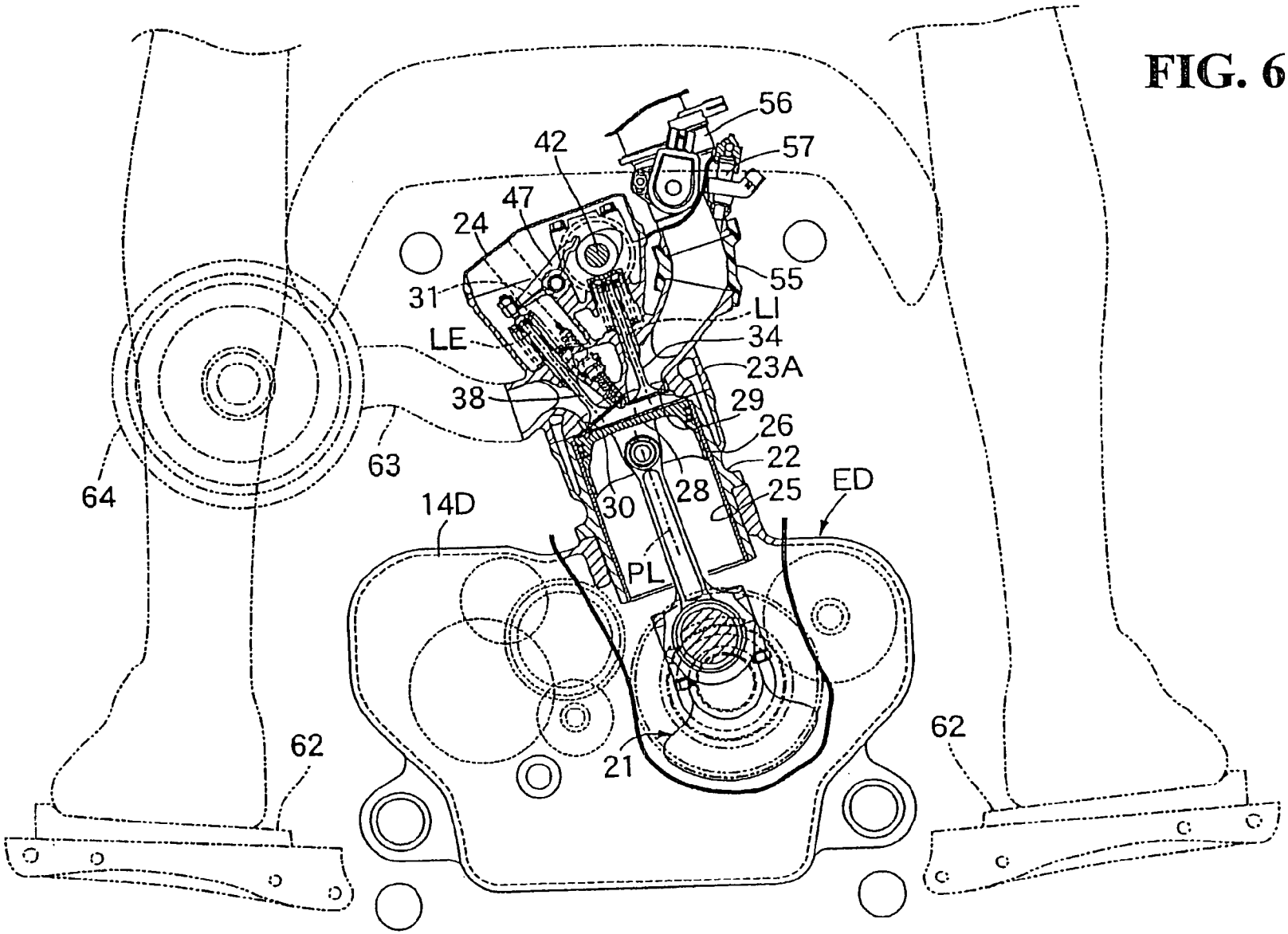
FIG. 6 is a vertical sectional view, as viewed from the rear side, of an internal combustion engine mounted on an all-terrain vehicle, showing a fourth embodiment of the present invention.

FIG. 6 shows a fourth embodiment of the present invention, and is a vertical sectional view, as viewed from the rear side, of an internal combustion engine mounted on an all-terrain vehicle. The parts corresponding to those in the first to third embodiments above are denoted by the same reference symbols as used above, and detailed description of the parts will be omitted.

The internal combustion engine ED is disposed between a left-right pair of steps 62, 62 on which the feet of the rider of the all-terrain vehicle are to be placed. The internal combustion engine ED is a two-cylinder engine with a crankshaft 21 set along the front-rear direction of the vehicle. The internal combustion engine ED includes cylinder blocks 22 each of which is provided with a cylinder bore 25 having an axis inclined to the left side as viewed from the rear side of the vehicle and is connected to a crankcase 14C, cylinder heads 23A connected to the cylinder blocks 22, and head covers 24 connected to the cylinder heads 23A.

Like in the first embodiment, intake valves 34 and exhaust valves 38 that are disposed respectively in the cylinder heads 23A so as to be capable of opening and closing are driven to open and close by a camshaft 42 and a rocker arm 47 swingably borne by a rocker shaft 46. The operation axes LI of the intake valves 34 are set substantially parallel to the axis of the cylinder bore 25. The operation axes LE of the exhaust valves 38 are so set as to skewly intersect the plane PL containing the axis of the cylinder bore 25 and parallel to the axis of the crankshaft 21. The structure of combustion chambers 28 is also the same as in the first embodiment.

One-side surfaces (the right side surfaces as viewed from the rear side of the vehicle) of the cylinder heads 23A are formed to be substantially parallel to the axes of the cylinder bores 25. Connecting pipe portions 50A integrally projected from the one-side surfaces are opened into an intake port 51 connected in common to intake valve ports 29. An intake pipe 55 that is continuous with the intake port 51 is connected to the connecting pipe portion 50A. The intake pipe 55 is connected to a throttle body 56 to which a fuel injection valve 57 is added. The throttle body 56 is disposed substantially in parallel to the one-side surface of the cylinder head 23A, which is formed to be substantially parallel to the axis of the cylinder bore 25 and in which the intake port 51 is opened.

In addition, a connecting pipe portion 52 is integrally projected from the other-side surface of the cylinder head 23A. An exhaust port 53 that is continuous with exhaust valve ports 30 is opened into the connecting pipe portion 52. An exhaust gas discharged from the exhaust port 53 is led through an exhaust pipe 63 to an exhaust muffler 64.

According to the fourth embodiment, it is possible to obtain the effects obtained in the first to third embodiments above, except for the effects intrinsic of the V-type internal combustion engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine, comprising:

a piston slidably fitted in a cylinder bore;

a combustion chamber formed between a cylinder block and a cylinder head, a top portion of said piston fronting said combustion chamber;

an intake valve port that is opened and closed by an intake valve, said intake valve port being provided in said cylinder head to open into the combustion chamber on one side of a plane containing an axis of the cylinder bore;

an exhaust valve port that is opened and closed by an exhaust valve, said exhaust valve port being provided in said cylinder head to open into the combustion chamber on the other side of said plane; and a spark plug having a tip end that fronts a substantially central portion of said combustion chamber, said spark plug being attached to said cylinder head and being disposed between said intake valve and said exhaust valve, wherein an operation axis of said intake valve is set to be substantially parallel to the axis of said cylinder bore, and wherein a ceiling surface of said combustion chamber is provided, between said spark plug and said intake valve port, with a partition wall projecting toward said piston.

2. The internal combustion engine according to claim 1, wherein one side surface of said cylinder head, in which an intake port opens contiguous with said intake valve port, is formed to be substantially parallel to the axis of said cylinder bore.

3. The internal combustion engine according to claim 1, wherein one side surface of said cylinder head, in which an intake port opens contiguous with said intake valve port, is formed to be substantially parallel to the axis of said cylinder bore.

4. The internal combustion engine according to claim 1, wherein the operation axis of said exhaust valve is so set as to skewly intersect said plane, and at least a part of said exhaust valve port is disposed above on the upper side relative to said partition wall.

5. The internal combustion engine according to claim 4, wherein one side surface of said cylinder head, in which an intake port opens contiguous with said intake valve port, is formed to be substantially parallel to the axis of said cylinder bore.

6. The internal combustion engine according to claim 1, wherein the tip end of said spark plug is disposed at substantially the same position as a projecting end of said partition wall.

7. The internal combustion engine according to claim 6, wherein one side surface of said cylinder head, in which an intake port opens contiguous with said intake valve port, is formed to be substantially parallel to the axis of said cylinder bore.

8. The internal combustion engine according to claim 6, wherein the operation axis of said exhaust valve is so set as to skewly intersect said plane, and at least a part of said exhaust valve port is disposed above on the upper side relative to said partition wall.

9. The internal combustion engine according to claim 8, wherein one side surface of said cylinder head, in which an intake port opens contiguous with said intake valve port, is formed to be substantially parallel to the axis of said cylinder bore.

10. An internal combustion engine, comprising:

a piston slidably fitted in a cylinder bore;

a combustion chamber formed between a cylinder block and a cylinder head, a top portion of said piston fronting said combustion chamber, said cylinder head being provided with an intake valve port opening into said combustion chamber on one side of a plane containing an axis of said cylinder bore, and with an exhaust valve port opening into said combustion chamber on the other side of said plane;

an intake valve disposed in said cylinder head to be able to open and close said intake valve port;

a camshaft for driving said intake valve to open and close, said camshaft being disposed on an operation axis of said intake valve;

an exhaust valve disposed in said cylinder head to be able to open and close said exhaust valve port;

a rocker shaft fixedly disposed between said exhaust valve and said camshaft; and a rocker arm swung according to rotation of said camshaft to drive said exhaust valve to open and close, said rocker arm being swingably borne by said rocker shaft, wherein the operation axis of said intake valve is set substantially parallel to the axis of said cylinder bore.

11. The internal combustion engine according to claim 10, wherein said intake valves are disposed respectively on the sides, close to each other, of a pair of said cylinder heads respectively constituting parts of a pair of banks disposed in a mutually V-shaped arrangement.

12. The internal combustion engine according to claim 10, wherein an intake system member connected to said intake port is disposed substantially along one side surface of said cylinder head.

13. The internal combustion engine according to claim 12, wherein said intake valves are disposed respectively on the sides, close to each other, of a pair of said cylinder heads respectively constituting parts of a pair of banks disposed in a mutually V-shaped arrangement.

14. The internal combustion engine according to claim 10, wherein one side surface of said cylinder head, in which an intake port opens contiguous with said intake valve port, is formed to be substantially parallel to the axis of said cylinder bore.

15. The internal combustion engine according to claim 14, wherein said intake valves are disposed respectively on the sides, close to each other, of a pair of said cylinder heads respectively constituting parts of a pair of banks disposed in a mutually V-shaped arrangement.

16. The internal combustion engine according to claim 14, wherein an intake system member connected to said intake port is disposed substantially along one side surface of said cylinder head.

17. The internal combustion engine according to claim 16, wherein said intake valves are disposed respectively on the sides, close to each other, of a pair of said cylinder heads respectively constituting parts of a pair of banks disposed in a mutually V-shaped arrangement.

* * * * *